106-85 AU 113 EX
9/5/78 XR 4,111,705

United States Patent [19]
Junovich et al.

[11] 4,111,705
[45] Sep. 5, 1978

[54] SELF-HARDENING MOULDING MIXTURE FOR MAKING FOUNDRY MOULDS AND CORES

[76] Inventors: July Moiseevich Junovich, Veshnyakovskaya ulitsa, 11, korpus 1, kv. 201; Sergei Semenovich Zhukovsky, Profsojuznaya ulitsa, 17, korpus 1, kv. 15, both of Moscow; Lev Girshovich Sudakas, ulitsa Shelgunova, 15, kv. 6; Ljudmila Ivanovna Turkina, Tallinskoe shosse, 62, kv. 46, both of Leningrad; Anatoly Ilich Smirnov, ulitsa Novinki, 23, korpus 2, kv. 61, Moscow; Abram Moiseevich Lyass, Sharikopodshipnikovskaya ulitsa, 2, kv. 42, Moscow; Sergei Dmitrievich Teplyakov, Seleznevskaya ulitsa, 13, kv. 3, Moscow, all of U.S.S.R.

[21] Appl. No.: 675,458

[22] Filed: Apr. 9, 1976

Related U.S. Application Data

[63] Continuation of Ser. No. 472,914, May 23, 1974, abandoned.

[51] Int. Cl.[2] ..... B28B 7/34
[52] U.S. Cl. ..... 106/38.35; 106/38.3; 106/85; 164/37
[58] Field of Search ..... 106/38.3, 38.35, 38.9, 106/85, 286; 164/37

[56] References Cited

U.S. PATENT DOCUMENTS

| | | | |
|---|---|---|---|
| 2,072,212 | 3/1937 | Moosdorf et al. | 106/38.9 |
| 2,161,319 | 6/1939 | Schamberger | 106/286 |
| 2,450,952 | 10/1948 | Greger | 106/35 |
| 2,522,548 | 9/1950 | Streicher | 106/38.9 |
| 2,610,957 | 9/1952 | Steinman et al. | 106/286 |
| 3,316,110 | 4/1967 | Herbst | 106/65 |

*Primary Examiner*—Lorenzo B. Hayes
*Attorney, Agent, or Firm*—Holman & Stern

[57] ABSTRACT

A self-hardening moulding mixture for making foundry moulds or cores, comprising moulding sand, orthophosphoric acid, a ferrous oxide-containing material, a water-soluble salt of an alkali metal or ammonium, and a carboxylic acid having one dissociation constant not exceeding $10^{-4}$ or a water-soluble salt of an alkali metal or ammonium, and an isopolyacid formed by a chromium subgroup metal, manganese oxide or urea.

The self-hardening moulding mixture can also comprise a surface-active substance acting as a foaming agent in order to render the mixture to a fluid state and to avoid compacting when producing moulds and cores therefrom.

The moulding mixture features an enhanced bench life (10–15 min) and ensures a sufficiently high hardening and strength rates (compression strength is equal to 10–25 kg/cm$^2$) for the foundry moulds and cores produced therefrom.

8 Claims, No Drawings

SELF-HARDENING MOULDING MIXTURE FOR MAKING FOUNDRY MOULDS AND CORES

This is a continuation of application Ser. No. 472,914 filed May 23, 1974 now abandoned.

The present invention relates to foundry practice and more particularly to a self-hardening moulding mixture for making foundry moulds and cores.

In making foundry moulds and cores from a mixture containing a ground refractory material-such as quartz sand, olivine, zircon and chromite, which act as a backing sand, and referred to hereinafter as moulding sand, orthophosphoric acid, ferrous oxide, or a ferrous oxide-containing material-the filling of the core and moulding boxes presents difficulties due to the necessity of quickly distributing the mixture within a box space, or on a pattern, and to make a core or a mould from that mixture.

Due to considerable heat generating from the above mixture resulting from the interaction between orthophosphoric acid and ferrous oxide, the sand hardening rate increases materially. Under these conditions the technological operations involved in making heavy moulds and cores (distribution of moulding mixture in a core box space or on a pattern, setting up of the core iron and gating system elements, etc.) also presents some problems ensuing from an inadequate bench life of the above mixture. The term "bench life" is to be understood as a time period; from the moment the processing of the moulding materials starts, within which the processes of hardening and strengthening of the moulding mixture have not yet been initiated, with the sand retaining its initial properties acquired, to its conditioning which is required for filling core or moulding box, which may be practically of any of the most intricate profiles, and for making a high-quality cores and moulds.

The main object of the present invention is to provide a self-hardening mixture for making foundry moulds and cores featuring an enhanced bench life (from 10 to 20 min).

Still another object of the invention is the provision of a self-hardening mixture for foundry moulds and cores of a self-hardening mixture for foundry moulds and cores which would allow the simplification of the procedure of making moulds and cores by decreasing the labour input required for compacting the moulding mixture by being able to pour a fluid mixture on the patterns and into the core boxes.

Yet another object of the present invention is the provision of a self-hardening mixture for foundry moulds and cores which would permit making heavy moulds and cores featuring high quality, particularly ensuring better reproduction of the pattern, and practically eliminating completely any crumbling of the moulds and cores produced therefrom.

Said and other objects of the present invention are achieved by combining a self-hardening sand or a mixture of, moulding sands, with orthophosphoric acid, a ferrous oxide-containing material, at least a single compound selected from the group consisting of a water-soluble salt of an alkali metal or ammonium and a carboxylic acid having one dissociation constant not exceeding $10^{-4}$, a water-soluble salt of an alkali metal or ammonium and an isopolyacid formed by a chromium subgroup metal, manganese oxide and urea.

It has been found that the introduction of the above-listed compounds into the proposed sand or mixture, decelerates the interaction between orthophosphoric acid and ferrous oxide extending thereby the bench life of the mixture.

Application of the herein-proposed self-hardening mixture containing the aforesaid compounds, results in a suitable product.

We have ascertained that the above suitable properties and advantages of the proposed moulding mixture containing moulding sand, orthophosphoric acid, and a ferrous oxide-containing material become manifest most efficiently with the proportion of the above compounds ranging from 0.05 to 5.0 parts of the weight of the moulding sand.

When the amount of the aforesaid compounds in the proposed mixture is less than 0.05 parts by weight, it does not produce any appreciable influence on its characteristics, while the proportion in excess of 5.0 parts by weight is inexpedient, since in this case the hardening process may not start at all.

A citrate of an alkali metal and ammonium can be cited as an example of a water-soluble salt of an alkali metal or ammonium and carboxylic acid having one dissociation constant not exceeding $10^{-4}$.

An oxalate of an alkali metal or ammonium may be also selected as another example of a water-soluble salt of an alkali metal or ammonium and carboxylic acid with one dissociation constant not exceeding $10^{-4}$.

As a third example of a water-soluble salt of an alkali metal or ammonium and a carboxylic acid with one dissociation constant not exceeding $10^{-4}$, is an acetate of an alkali metal or ammonium.

Finally, a tartrate of an alkali metal or ammonium can be cited as one more example of a water-soluble salt of an alkali metal or ammonium and a carboxylic acid having a dissociation constant not exceeding $10^{-4}$.

As for an example of a water-soluble salt of an alkali metal or of ammonium, and an isopolyacid formed by a chromium group metal, are chromates and bichromates, tungstates and bitungstates, molybdates and bimolybdates of the alkali metal, or the ammonium group.

The introduction of the proposed mixture of manganese oxides assists in increasing the bench life. The best results are obtained by using manganese dioxide or a manganese oxide.

Said manganese oxides can be introduced either in a pure state or with manganese oxide-containing materials. Manganese dioxide can be used in the form of powdered pyrolusite, or ramsdellite, while braunite can be quoted as an example of a manganese oxide-containing material.

In order to obviate the compacting of the self-hardening mixture for making foundry moulds and cores, a mixture containing moulding sand, orthophosphoric acid and a ferrous oxide-containing material may also contain a foaming agent in amounts ranging from 0.1 to 1.0% by weight of the moulding sand.

Said foaming agent makes it possible eliminate compacting, insofar as under the effect of the foaming action, the sand is rendered into the fluid state through which the charging and compacting of the mixture is replaced by pouring it on a pattern or in a core box.

Sodium alkyl aryl sulfonic acid is an example of a foaming agent which can be added to the proposed moulding mixture.

Further, according to the invention, the herein-proposed moulding mixture is employed in making foundry moulds and cores by one of the known procedures with the moulds and cores are self-hardened in air.

Given hereinbelow is a detailed description of illustrative embodiments of the invention.

A method of preparing a self-hardening mixture for making foundry moulds and cores comprises the following steps;

Orthophosphoric acid, a ferrous oxide-containing material and one of the aforesaid compounds are introduced into the moulding sand which is the main component of the proposed moulding mixture. As for the above-mentioned compounds, a water-soluble salt of an alkali metal, or ammonium, and a carboxylic acid having one dissociation constant not exceeding $10^{-4}$; can be used or a water-soluble salt of an alkali metal, or ammonium, and isopolyacid formed by a chromium subgroup metal, or maganese oxide, or urea can also be used.

Said components may be introduced into the moulding sand either simultaneously or in any desired sequence.

We have found that the most efficient results are obtained by the preliminary introduction of the above components in a pulverized state into the orthophosphoric acid. In the case where the manganese oxides are introduced in the form of manganese oxide-containing materials, it is advisable to add the latter to the moulding sand.

The materials are mixed for 2–3 min in order to impart uniformity to the sand mixture whereupon it is charged or poured onto a pattern, or into a core box, and compacted, if necessary, by using any known procedure.

Strengthening the moulds and cores produced is achieved due to their self-hardening ability in air which lasts for 25–30 min after the sand mixture has been prepared.

Usually quartz sand is employed in producing a moulding mixture. Depending upon the conditions of producing castings or local materials, of olivine or zircon sands and other refractory materials, such as chrome-magnesite, chromite, etc can be used.

In the herein-proposed self-hardening mixture, orthophosphoric acid and ferrous oxide, or a ferrous oxide-containing material, are used as the binder.

The interaction between orthophosphoric acid and ferrous oxide ensures strong binding properties between the sand grains as well as high-strength for moulds and cores produced.

The mixture hardening rates and strength properties can be adjusted by changing the concentration of orthophosphoric acid.

A higher concentration results in an increase in both the sand strength and its hardening rate.

The higher the concentration of the orthophosphoric acid, the smaller would be the requirements in the moulding sand in order to ensure the same strength characteristics of the moulds and cores. The concentration of orthophosphoric acid can be characterized by its density. According to the present invention, in the proposed self-hardening mixture, an aqueous acid solution with a density of 1.26–1.33 g/cm$^3$ can be used, which corresponds to a 40–50% acid.

The contents of of 40–50% orthophosphoric acid in the moulding mixture ranges from 4 to 12%, and preferably from 6 to 8%, of the weight of the moulding sand.

It is expedient that the ferrous oxide-containing materials comprise not less than 30% by weight of ferrous oxide. In this case the mixture would contain 2.0–6.0% by weight of ferrous oxide (of the weight of the moulding sand).

As for the ferrous oxide-containing materials, iron scales which is a waste product obtained from the heat treatment of blanks for further rolling and forging can be used. The above material contains up to 70% by weight of ferrous oxide.

Ferrous oxides are introduced into the moulding mixture in a comminuted form. The grain fineness number or specific surface area determined by filtration of air through a layer of the pulverized material, and calculated by Cosenie-Carmand method varies from 800 to 2500 cm$^2$/g. In this case, the larger the specific surface area, the higher the mixture hardening rate, and the strength of moulds and cores produced therefrom.

As for the water-soluble salt of an alkali metal or an ammonium radical, and a carboxylic acid with one dissociation constant not exceeding $10^{-4}$, use can be made of citrates (potassium, sodium and ammonium citrates), acetates (potassium, sodium, ammonium acetates), oxalates (potassium, sodium, ammonium oxalates), tartrates (potassium, sodium and ammonium tartrates), valerates (potassium, sodium and ammonium valerates), glycolates (potassium, sodium and ammonium glycolates), butyrates (potassium, sodium and ammonium butyrates), formates (potassium, sodium and ammonium formates), propionates (potassium, sodium and ammonium propionates).

The alkali metals are the elements of the first group (lithium-cesium group) of Mendelyeev's periodic system, with potassium and sodium being the most widely used of the above elements. Therefore the salts of these metals are usually used in the proposed moulding mixture.

Another compound ensuring the adjustment of the bench life of the self-hardening moulding mixture, according to the present invention, is a water-soluble salt of an alkali metal, or ammonium radical and an isopolyacid formed by a chromium subgroup metal.

Peculiar to the metals of the chromium subgroup (Cr, Mo, W) is the formation of isopolyacids having the general formula $H_2O.\times 90_3$, where denotes a metal from the chromium subgroup (Cr, Mo, W), and "$x$" ranges from 1 to 4.

Thus, when $x=1$, chromic acid is formed, when $x=2$ gives bichromic acid, when $x=3$ - trichromic acid, and when $x=4$ - tetrachromic acid.

The salts of the above acids are denoted as chromates, bichromates, trichromates and tetrachromates accordingly. The formation of such acids is also typical of molybdenum and tungsten. The salts of the isopolyacids in whose formula $x$ varies from 1 to 2 are among the most widespread, and the above salts are usually used in the moulding mixture, according to the present invention.

As for the water-soluble salt of an alkali metal or ammonium ion, and an isopolyacid formed by a chromium subgroup metal, the self-hardening moulding mixture, according to the invention, may comprise potassium, sodium or ammonium chromates and bichromates, tungstates and bitungstates, molybdates and bimolybdates.

According to the present invention, manganese oxide is also introduced into the proposed self-hardening mixture to extend its bench life within the required range.

In this case manganese oxides, particularly manganese dioxide and manganic oxide, can be added to the moulding sand either in the pure state or with the materials containing the above oxides.

As for the manganese dioxide-containing materials, it is expedient that pyrolusite or ramsdellite be used, with braunite being utilized as a manganic oxide-containing material.

The use of natural minerals, such as pyrolusite, rams-,and braunite as the manganess oxide-containing materials affords the possibility of achieving the same results as with the use of pure oxides provided that the amount of the manganese dioxide or manganese oxide required for producing the prescribed mixture characteristics is within 0.05–5.0 percent of the weight of the moulding sand.

Urea $CO(NH_2)_2$ — a carbamide constitutes one more compound required for adjusting the bench life of the moulding mixture. It is a crystalline substance readily soluble in water.

According to the present invention, the self-hardening moulding sand may contain amionic, cationic and nonionogenic surface-active materials characterized by their foaming action, with the proportion of the surface-active substances varying from 0.05 to 1.0% of the weight of the moulding sand.

The best results are obtained by using an anionic surface-active substances, e.g. alkyl aryl sulfonates, alkyl sulfonates and alkyl sulfates.

Sodium salts of an alkyl aryl sulfonic acid, such as a sodium salt of butyl naphthalene sulfonic acid, with a $C_4$–$C_{12}$ in the alkyl radial, and a $C_{10}$ in the aryl radial, may be cited as an example of a foaming agent. The salt thereof is known under its trade name "Wetting agent Hb". It applies equally to a mixture of sodium salts of alkyl aryl sulfonic acids with $C_8$–$C_{12}$ in the alkyl radial and a $C_6$ in the aryl radial, and known under the trade name A C-PAC.

The use of said foaming agents ensures the requisite flowability and foam stability of the moulding mixture that are large enough to pour into the moulds and cores.

Illustrative examples of the embodiment of the present invention are given hereinbelow.

EXAMPLE 1

The following constituents are taken for preparing a plastic moulding mixture (parts by weight):

| | | |
|---|---|---|
| quartz sand | | 94 |
| iron scales (specific surface area | - 1500 $cm^2/g$; | |
| FeO content | - 48% by weight) | 6 |
| 50% orthophosphoric acid | | 6 |
| ammonium acetate | | 0.4. |

The following procedure is used for preparing the mixture. Iron scales and orthophosphoric acid, into which ammonium acetate has been introduced beforehand, are added to quartz sand. The above materials can be introduced either concurrently or in any sequence desired. Mixing continues for 2–3 min until a uniform composition is obtained. Next a mould or a core is produced from the mixture by using any conventional method.

The bench life of the moulding mixture amounts to 10–15 min. The compression strength of standard air self-hardened specimens is equal to 10 $kg/cm^2$ after 1 hr and 24 $kg/cm^2$ after 24 hrs.

EXAMPLE 2

The following constituents are taken for preparing a plastic moulding mixture (parts by weight):

| | | |
|---|---|---|
| quartz sand | | 94 |
| iron scales (specific surface area | - 1500 $cm^2/g$; | |
| FeO contents | - 48% by weight) | 6 |
| 50% orthophosphoric acid | | 6 |
| potassium citrate | | 0.6 |

The mixture is prepared as described in Example 1. The bench life of the mixture amounts to 10–15 min. The compression strength of standard air self-hardened specimens is equal to 11 $kg/cm^2$ after 1 hr, and 25 $kg/cm^2$ after 24 hrs.

EXAMPLE 3

In order to prepare a plastic moulding mixture the following constituents are taken (parts by weight):

| | | |
|---|---|---|
| quartz sand | | 94 |
| iron scales (specific surface area | - 1500 $cm^2/g$; | |
| FeO contents | - 48% by weight) | 6 |
| 50% orthophosphoric acid | | 6 |
| ammonium tartrate | | 0.7 |

The mixture is processed as described in Example 1. The bench life of the sand is from 10 to 15 min. The compression strength of standard air self-hardened specimens is 12 $kg/cm^2$ after 1 hr and 25 $kg/cm^2$ after 24 hrs.

EXAMPLE 4

In order to prepare a plastic moulding mixture, the following constituents are taken (parts by weight):

| | | |
|---|---|---|
| quartz sand | | 94 |
| iron scales (specific surface area | - 1500 $cm^2/g$; | |
| FeO contents | - 48% by weight) | 6 |
| 50% orthophosphoric acid | | 6 |
| bitungstate | | 0.3 |

The mixture is prepared as described in Example 1. The bench life of the mixture ranges within 10–15 min. The compression strength of standard air self-hardened specimens is 12 $kg/cm^2$ after 1 hr and 24 $kg/cm^2$ after 24 hrs.

EXAMPLE 5

The following constituents are taken for producing a plastic moulding mixture (parts by weight):

| | | |
|---|---|---|
| quartz sand | | 94 |
| iron scales (specific surface area | - 1500 $cm^2/g$; | |
| FeO contents | - 48% by weight) | 6 |
| 50% orthophosphoric acid | | 6 |
| potassium bichromate | | 0.8 |

| | | |
|---|---|---|
| quartz sand | | 94 |
| iron scales (specific surface area | - 1500 $cm^2/g$; | |
| FeO contents | - 48% by weight) | 6 |
| 50% orthophosphoric acid | | 6 |
| potassium bichromate | | 0.8 |

The mixture is conditioned as described in Example 1. The bench life of the mixture ranges from 10 to 15 min. The compression strength of standard air self-hardened specimens is 12 kg/cm² after 1 hr and 25 kg/cm² after 24 hrs.

EXAMPLE 6

The following constituents are taken for producing a plastic moulding mixture (parts by weight):

| | | |
|---|---|---|
| quartz sand | | 94 |
| iron scales (specific surface area | - 1500 cm²/g; | |
| FeO contents | - 48% by weight) | 6 |
| 50% orthophosphoric acid | | 6 |
| manganese dioxide | | 0.8 |

The mixture is processed as specified in Example 1. The bench life of the mixture varies from 10 to 15 min. The compression strength of the standard air self-hardened specimens is 9 kg/cm² after 1 hr, and 23 kg/cm² after 24 hrs.

EXAMPLE 7

The following constituents are taken for preparing a plastic moulding mixture (parts by weight):

| | | |
|---|---|---|
| quartz sand | | 94 |
| iron scales (specific surface area | - 1500 cm²/g; | |
| FeO contents | - 48% by weight) | 6 |
| 50% orthophosphoric acid | | 6 |
| pyrolusite | | 2 |

The mixture is prepared as follows: Iron scales, pyrolusite, orthophosphoric acid are added to the quartz sand simultaneously or in any other suitable sequency.

Mixing lasts for 2–3 min in order to obtain a uniform compound. Next a mould or a core is made from the above mixture by using any known procedure.

The bench life of the moulding mixture ranges from 10 to 15 min. The compression strength of standard air self-hardened specimens is 10 kg/cm² after 1 hr, and 22 kg/cm² after 24 hrs.

EXAMPLE 8

The following constituents are taken in order to prepare a plastic moulding mixture (parts by weight):

| | | |
|---|---|---|
| quartz sand | | 94 |
| iron scales (specific surface area | - 1500 cm²/g; | |
| FeO contents | - 48% by weight) | 6 |
| 50% orthophosphoric acid | | 6 |
| urea | | 0.5 |

The mixture is processed as specified in Example 1. The bench life of the mixture is 10–15 min. The compression strength of standard air self-hardened specimens is 13 kg/cm² after 24 hrs.

According to the present invention, a fluid self-hardening mixture can be prepared. To this end, i.e. the moulding mixture is rendered into a fluid state, and a foaming agent is additionally introduced thereinto, with its proportions ranging from 0.1 to 1.0% of the weight of the moulding sand.

EXAMPLE 9

The following constituents are taken for preparing a fluid self-hardening moulding mixture (parts by weight):

| | | |
|---|---|---|
| quartz sand | | 95 |
| iron scales (specific surface area | - 1500 cm²/g; | |

-continued

| | | |
|---|---|---|
| FeO contents | - 48% by weight) | 5 |
| 50% orthophosphoric acid | | 8 |
| sodium oxalate | | 0.5 |
| foaming agent (mixture of sodium salts of alkyl aryl sulfonic acid - "Wetting agent Hb") | | 0.25 |

The mixture is conditioned as follows: Iron scales and orthophosphoric acid, along with ammonium oralate and a foaming agent which have been introduced preliminary, are added to the quartz sand simultaneously, or in any desired sequence. Mixing is carried out for 2–3 min. Following this, the cores and moulds are made from the fluid mixture by pouring it into core boxes and on patterns.

The bench life of the mixture is 15–20 min. The compression strength of standard air self-hardened specimens is 10 kg/cm² after 1 hr and 23 kg/cm² after 24 hrs.

EXAMPLE 10

The following constituents are taken for preparing a fluid self-hardening moulding mixture (parts by weight):

| | | |
|---|---|---|
| quartz sand | | 95 |
| iron scales (specific surface area | - 1500 cm²/g; | |
| FeO contents | - 48% by weight) | 5 |
| 50% orthophosphoric acid | | 8 |
| sodium molybdate | 1.5 | |
| foaming agent (mixture of sodium salts of alkyl aryl sulfonic acid - "Wetting agent Hb") | | 0.3 |

The mixture is conditioned as specified in Example 9.

The bench life of the above mixture is from 15 to 20 min. The compression strength of standard air self-hardened specimens amounts to 10 kg/cm² after 1 hr, and 22 kg/cm² after 24 hrs.

EXAMPLE 11

The following constituents are taken for preparing a fluid self-hardening moulding mixture (parts by weight):

| | | |
|---|---|---|
| quartz sand | | 95 |
| iron scales (specific surface area | - 1500 cm²/g; | |
| FeO contents | - 48% by weight) | 5 |
| 50% orthophosphoric acid | | 8 |
| manganese oxide | | 1 |
| foaming agent (mixture of sodium salts of alkyl aryl sulfonic acid - "Wetting agent Hb") | | 0.3 |

The mixture is conditioned as specified in Example 9.

The bench life of the above mixture is from 15 to 20 min.

The compression strength of standard air self-hardened specimens is 11 kg/cm² after 1 hr, and 21 kg/cm² after 24 hours.

EXAMPLE 12

The following constituents are taken for preparing a fluid self-hardening moulding mixture (parts by weight):

| | | |
|---|---|---|
| quartz sand | | 95 |
| iron scales (specific surface area | - 1500 cm²/g; | |
| FeO contents | - 48% by weight) | 5 |
| 50% orthophosphoric acid | | 8 |
| braunite | | 3 |
| foaming agent (mixture of sodium salts of alkyl | | |

-continued

| | | |
|---|---|---|
| aryl sulfonic acids | - "Wetting agent Hb") | 0.7. |

The moulding mixture is conditioned as follows: Iron scales, braunite, orthophosphoric acid, along with the foaming agent preliminary introduced thereinto, are added to the quartz sand simultaneously, or in any desired sequence. Mixing continues for 2–3 min. Next, cores and moulds are produced from the fluid mixture thereof by pouring it into core boxes or on patterns.

The bench life of the moulding mixture varies from 15 to 20 min. The compression strength of standard air self-hardened specimens is 11 kg/cm$^2$ after 1 hr, and 23 kg/cm$^2$ after 24 hours.

EXAMPLE 13

The following constituents are taken in order to prepare a fluid self-hardening moulding mixture (parts by weight):

| | | |
|---|---|---|
| quartz sand | | 95 |
| iron scales (specific surface area | - 1500 cm$^2$/g; | |
| FeO contents | - 48% by weight) | 5 |
| 50% orthophosphoric acid | | 8 |
| urea | | 0.5 |
| foaming agent (mixture of sodium salts of alkyl aryl sulfonic acid - "Wetting agent Hb") | | 0.4 |

The moulding mixture is prepared as described in Example 9.

The bench life of the mixture is 15–20 min. The compression strength of standard air self-hardened specimens is 11 kg/cm$^2$ after 1 hr, and to 25 kg/cm$^2$ after 24 hours.

It is to be understood that the present invention is in no way limited to the specific moulding mixture examples disclosed herewitn and various modifications may be made by those skilled in the art, such as those falling within the true spirit and scope of the present invention as defined by the disclosure.

The cores and moulds made from the self-hardening mixture, according to the present invention, can be utilized in the production of steel, iron and non-ferrous metal castings.

The herein-proposed moulding mixture ensures the production of high-strength moulds and cores, including those for the manufacture of heavy castings. The bench life of the moulding mixture is long enough to carry out the technological operations involved in making moulds and cores with the mixture retaining high hardening rates.

What we claim is:

1. A self-hardening moulding mixture for making foundry mould and cores, comprising moulding sand, from 4–12% by weight of said moulding sand orthophosphoric acid, from 2–6% by weight of said moulding sand of a ferrous oxide-containing material, of from 0.05–5.0% by weight of sand moulding sand of a water-soluble salt of an alkali metal or an ammonium ion with a carboxylic acid with a dissociation constant not exceeding $10^{-4}$.

2. The self-hardening moulding mixture of claim 1, wherein the compound is selected from the group consisting of an alkali metal citrate and ammonium citrate.

3. The self-hardening moulding mixture of claim 1, wherein the compound is selected from the group consisting of an alkali metal oxalate and ammonium oxalate.

4. The self-hardening moulding mixture of claim 1, wherein the compound is selected from the group consisting of an alkali metal acetate and ammonium acetate.

5. The self-hardening moulding mixture of claim 1, wherein the compound is selected from the group consisting of an alkali metal tartrate and ammonium tartrate.

6. The self-hardening moulding mixture of claim 1, further containing a surfactant featuring a foaming action.

7. The self-hardening moulding mixture of claim 6, wherein the surfactant content ranges within 0.1–1.0% of the weight of moulding sand.

8. A method of making foundry moulds and cores comprising the steps of: preparing a mixture made of moulding sand, orthophosphoric acid, a ferrous oxide-containing material and a water-soluble salt of an alkali metal or an ammonium ion with a carboxylic acid with a dissociation constant not exceeding $10^{-4}$; shaping said moulds and cores from the mixture obtained; and hardening same in air.

* * * * *